United States Patent [19]

Halbach

[11] Patent Number: 4,761,584

[45] Date of Patent: Aug. 2, 1988

[54] STRONG PERMANENT MAGNET-ASSISTED ELECTROMAGNETIC UNDULATOR

[75] Inventor: Klaus Halbach, Berkeley, Calif.

[73] Assignee: The United States of America as represented by the United States Department of Energy, Washington, D.C.

[21] Appl. No.: 8,689

[22] Filed: Jan. 30, 1987

[51] Int. Cl.[4] ..... H01J 25/00

[52] U.S. Cl. ..... 315/4; 315/3; 315/5; 315/5.35

[58] Field of Search ..... 315/3, 4, 5, 5.35, 5.38, 315/5.31; 372/2, 37

[56] References Cited

U.S. PATENT DOCUMENTS

| | | | |
|---|---|---|---|
| 2,741,718 | 4/1956 | Wang | 315/5.35 X |
| 2,843,788 | 7/1958 | Peter | 315/5.35 X |
| 3,072,817 | 1/1963 | Gordon | 315/5.34 X |
| 3,259,786 | 7/1966 | Phillips | 315/5.41 |
| 3,789,257 | 1/1974 | Friedman et al. | 315/5 |
| 4,392,078 | 7/1983 | Noble et al. | 315/5 |

*Primary Examiner*—David K. Moore
*Assistant Examiner*—Michael Razavi
*Attorney, Agent, or Firm*—Clifton E. Clouse, Jr.; Roger S. Gaither; Judson R. Hightower

[57] ABSTRACT

This invention discloses an improved undulator comprising a plurality of electromagnet poles located along opposite sides of a particle beam axis with alternate north and south poles on each side of the beam to cause the beam to wiggle or undulate as it travels generally along the beam axis and permanent magnets spaced adjacent the electromagnetic poles on each side of the axis of said particle beam in an orientation sufficient to reduce the saturation of the electromagnet poles whereby the field strength of the electromagnet poles can be increased beyond the normal saturation levels of the electromagnetic poles.

6 Claims, 3 Drawing Sheets

STRONG PERMANENT MAGNET-ASSISTED ELECTROMAGNETIC UNDULATOR

BACKGROUND OF THE INVENTION

This invention described herein arose in the course of, or under, Contract No. DE-AC03-76SF00098 between the U.S. Department of Energy and the University of California.

This invention relates to an improved undulator. More particularly, this invention relates to an improved undulator having electromagnetic poles with permanent magnets positioned adjacent thereto to reduce the saturation of the electromagnet cores to permit the field strength of the electromagnet pole to be proportional to the applied current at levels where the iron in the electromagnet would normally be saturated.

In a paper entitled "Application of Permanent Magnets in Accelerators and Storage Rings (Invited)", published in the Journal of Applied Physics, Volume 57, No. 8, Part IIA, in April, 1985, on pages 3605–3608, I discussed the generic advantages of the use of permanent magnets over electromagnets, particularly when the linear dimensions L of the magnet is small. Specifically, I pointed out that when a magnetically significant dimension of a magnet is very small, a permanent magnet will always produce higher fields than an electromagnet and that, therefore, with permanent magnets one can reach regions of parameter space that are not accessible with any other technology. I then discussed building undulators using uniformly magnetized blocks of permanent magnet material such as rare earth-cobalt, referred to as current sheet equivalent material or charge sheet equivalent material (CSEM), and showed several configurations for producing magnetic fields with CSEM blocks.

Undulators or wigglers have also been produced using electromagnetic windings, such as shown in Madey et al U.S. Pat. No. 4,283,687, which shows double helix windings wherein the current in the two strands of the double helix flows in opposite directions. The magnetic field produced by the current flowing in the coils rotates in space with the period of the helix.

The use of electromagnets in a tapered undulator or wiggler is advantageous to permit field adjustments to the undulator as well as to permit change of the field level in selected undulator modules to utilize diagnostic methods other than magnetic field measurements to determine needed settings of steering, displacement, and phase shift correctors.

If wide adjustment range of the field strength were the only consideration, a pure electromagnetic undulator would be a clear choice. Unfortunately, the field strength obtainable with electromagnetic undulators of short period length is not comparable with the field strength of a permanent magnet system, for example, where iron is sandwiched between strong permanent magnet material, such as samarium-cobalt.

In a paper entitled "Concepts for Insertion Devices That Will Produce High-Quality Synchrotron Radiation" dated July, 1985, I discussed effects of construction tolerances on the field distribution in undulators and described a number of new conceptual designs that allow electromagnetic correction of the field distribution in these undulators including the use of permanent magnet material in combination with electromagnetic coils.

SUMMARY OF THE INVENTION

The present invention relates to an improved undulator/wiggler which permits achievement of high field strength in an electromagnet pole beyond that normally achievable due to saturation of the electromagnet core. The high field strength is achieved by the use of permanent magnets to inhibit the saturation of the electromagnet cores.

It is therefore an object of this invention to provide an improved undulator which provides high field strength without saturating the cores of the electromagnet poles.

It is another object of this invention to provide an improved undulator which provides high field strength while without saturating the cores of the electromagnet poles by placing permanent magnet material in between adjoining electromagnetic poles of opposite polarity.

It is yet another object of this invention to provide an improved undulator which provides high field strength without saturating the cores of the electromagnet poles by placing permanent magnet material in between adjoining electromagnetic poles of opposite polarity with the magnetic axis of the permanent magnet material normal to the magnetic axis of the electromagnet poles.

It is a still further object of this invention to provide an improved undulator which provides high field strength without saturating the cores of the electromagnet poles by placing permanent magnet material in between adjoining electromagnetic poles of opposite polarity with the north pole of the magnetic axis of the permanent magnet facing toward the north electromagnet poles and away from the south electromagnetic poles.

These and other objects of the invention will be apparent from the following description and accompanying drawings.

In accordance with the invention, a plurality of electromagnet poles in an undulator are located along opposite sides of a particle beam axis with alternate north and south poles on each side of the beam to cause the beam to wiggle or undulate as it travels generally along the beam axis, the improvement which comprises permanent magnets spaced adjacent electromagnetic poles on each side of the axis of said particle beam in an orientation sufficient to reduce the saturation in the electromagnet poles to thereby permit the increase the field strength of the magnetic field beyond normal saturation of the electromagnet material.

DETAILED DESCRIPTION OF THE INVENTION

Figure 1:
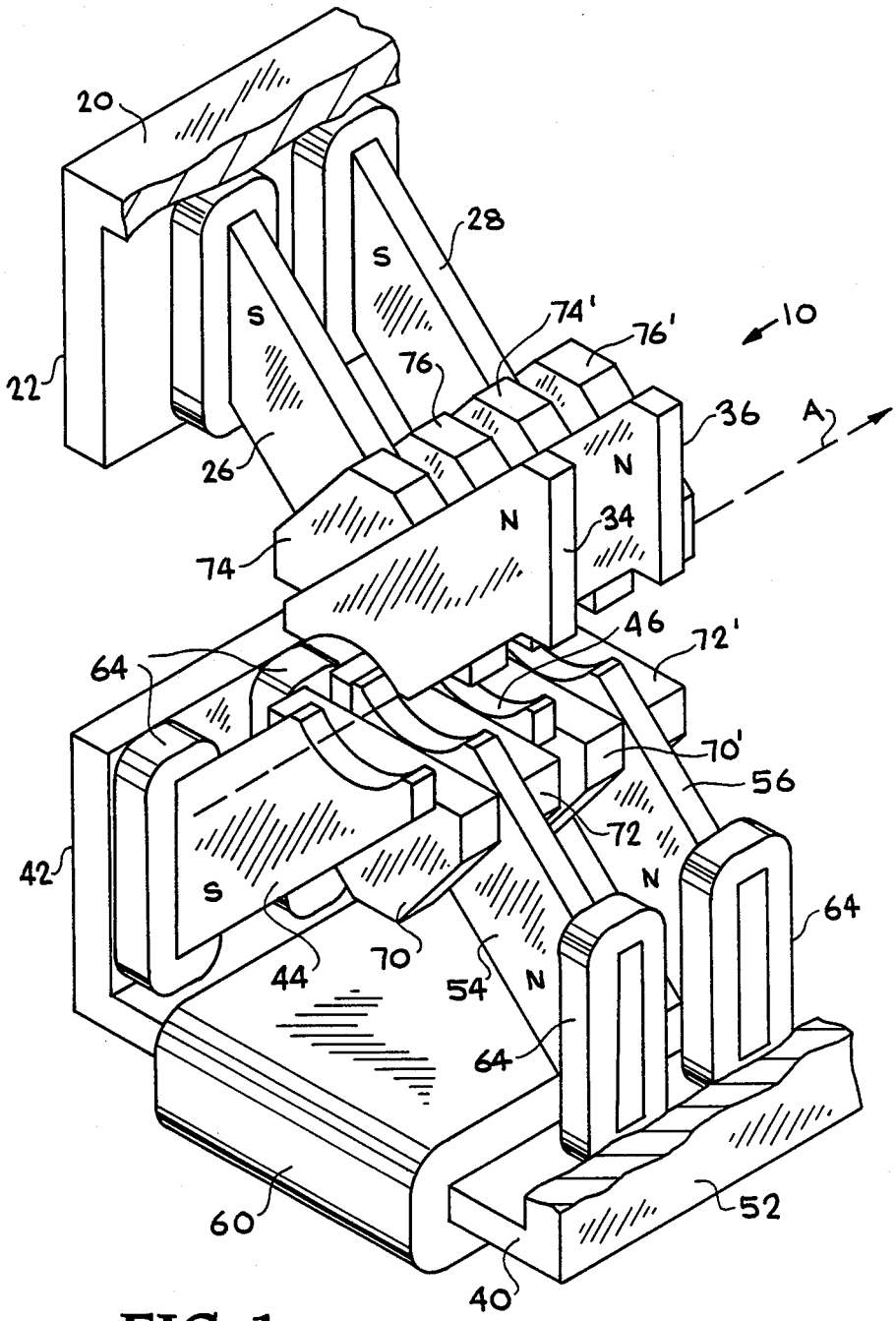
FIG. 1 is a partially cutaway isometric view of a preferred embodiment of the undulator of the invention.

Referring now to FIG. 1, the undulator of the invention is generally indicated at 10 comprising an upper magnetic bus 20 and a lower magnetic bus 40 each comprising a ferromagnetic material. Each of the magnetic buses is powered by a main electromagnetic coil, such as coil 60 shown around lower magnetic bus 40.

Magnetic buses 20 and 40, in the illustrated embodiment, are generally U-shaped with the respective legs of the buses facing one another, i.e., leg 22 of bus 20 faces leg 42 of bus 40, while leg 52 of bus 40 faces the corresponding leg (not shown) of bus 20. Each of the bus legs has a number of poles depending therefrom toward one another at an angle of about 45° to the bus legs and terminating at a point equally spaced from a common axis A which generally defines the axis of a particle beam which is acted upon by undulator 10.

The magnetic poles depending from each bus are disposed in alternate spacing laterally along one side of the axis A of the beam so that, as shown in FIG. 1 (and partially in FIG. 2), south pole 44 depending from leg 42 of bus 40 is followed by north pole 54 from bus 52 of the same bus followed by south pole 46 and then north pole 56.

Correspondingly, south pole 24 (in FIG. 2) of leg 22 of magnetic bus 20 terminates across from north pole 54 and is followed in lateral succession by a north pole 36 from the leg of bus 20 (not shown), which has been cut away in FIG. 1 for illustrative purposes, and then by south pole 28.

Figure 2:
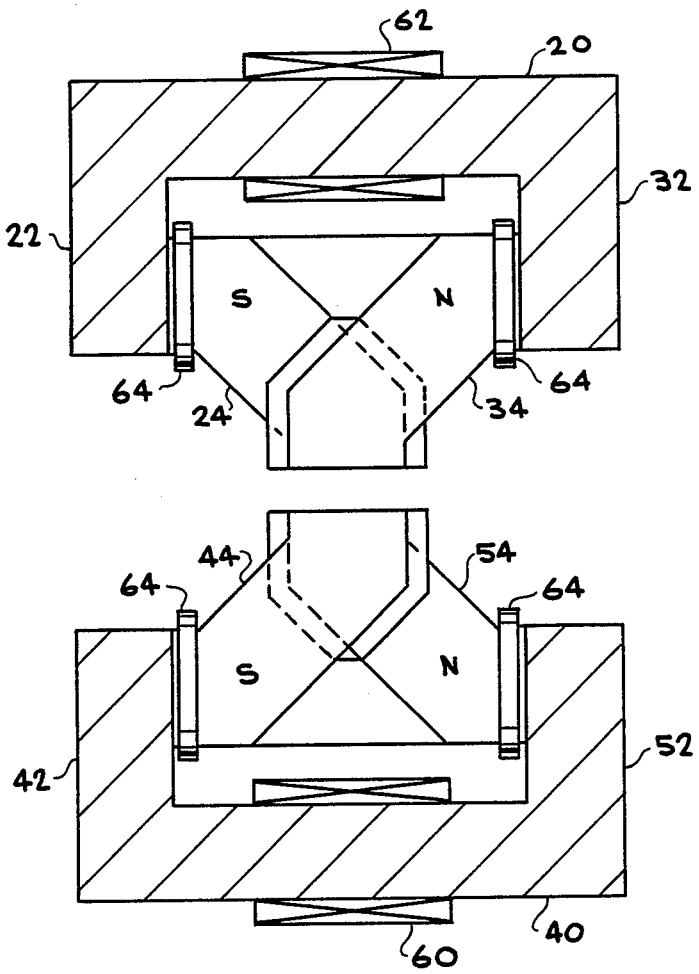
FIG. 2 is an end sectional view of the undulator shown in FIG. 1.

Thus, the charged particle beam traveling generally along axis A first encounters north pole 34 and its opposed south pole 44 which bends the particle beam in one direction a beam of negative particles traveling into the plane of the paper in FIG. 2, and then the particle beam is bent in an opposite direction as the beam encounters south pole 24 and its opposed north pole 54 to provide the desired wiggle or undulation of the charged particle beam.

Each of the poles of the electromagnets is provided with its own individual correcting coil 64 so that minor variations in the physical size of the pole or variations in the properties of the iron in the particular pole may be compensated for by adjustment of the power level (or for that matter, the number of turns, if necessary) of each individual correction coil.

While the undulator, to the extent just described, would provide the desired flexibility of field adjustment characteristic of electromagnets, in accordance with the invention, the field strength of the undulator electromagnets may be increased beyond the field strength normally achieved at saturation of the iron core of the electromagnets by spacing and properly orienting permanent magnets between alternate poles of the electromagnets of the undulator to inhibit or prevent saturation of the electromagnets.

Thus, as best seen in FIG. 1, a permanent magnet 70 is placed between south pole 44 and north pole 54 followed by a permanent magnet 72 between north pole 54 and south pole 46. Correspondingly, permanent magnet 74 is placed between north pole 34 and south pole 26 followed by permanent magnet 76 between south pole 26 and north pole 36.

It will be noted that the magnetic or easy axis (north pole) of the permanent magnets 70–74 is in a direction normal to and facing the respective north poles of the electromagnets and away from the respective south poles. This orientation is continued in repetitive fashion along the axis A of the beam path as shown by permanent magnets 70'–74' in FIG. 1. It will also be noted that the shape of the permanent magnets 70–74 (and their repetitive counterparts 70'–74') along the beam path is generally triangular with the widest portion of the permanent magnet adjacent the beam path and the narrowest portion facing toward the center of the U of the respective magnetic buses.

Permanent magnet material which may be used in the construction of the permanent magnets of the invention include rare earth-cobalt materials, e.g., neodymium-iron-boron and samarium-cobalt, the latter having a remanent field typically of 10 kiloGauss and a coercive field of 9.5 kiloGauss.

Characteristic dimensions of the permanent magnets are roughly triangular shaped with a 7 cm. base and a thickness of 1.1 cm to achieve a field strength of 4 kiloGauss. The field strength is achieved by passing a current of about 360 amps through 32 turns on the coil of each electromagnet. The period is 8 cm. and the gap is 3 cm.

The purpose of the orientation and shape of the permanent magnets is to maximize the reduction in saturation of the iron core of the electromagnet to thereby permit achievement of higher field strength in the electromagnet poles of the undulator than previously possible due to saturation of the electromagnet cores.

Figure 3:
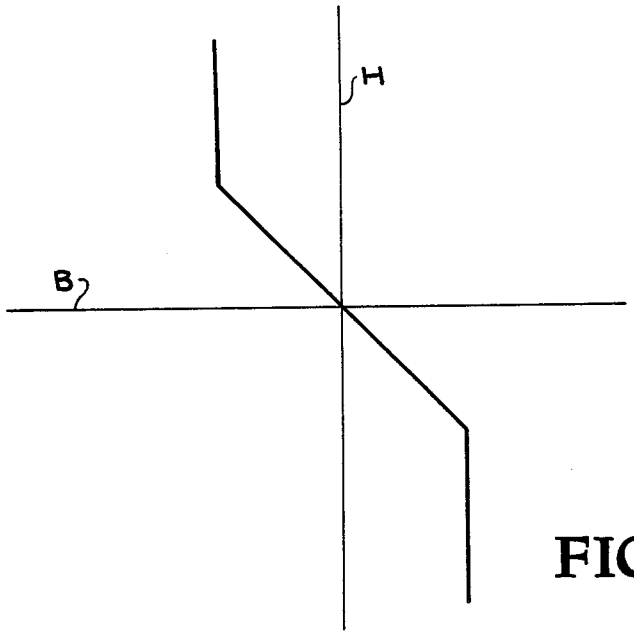
FIG. 3 is a graph schematically showing the conventional B-I curve of electromagnets without permanent magnets.
Figure 4:
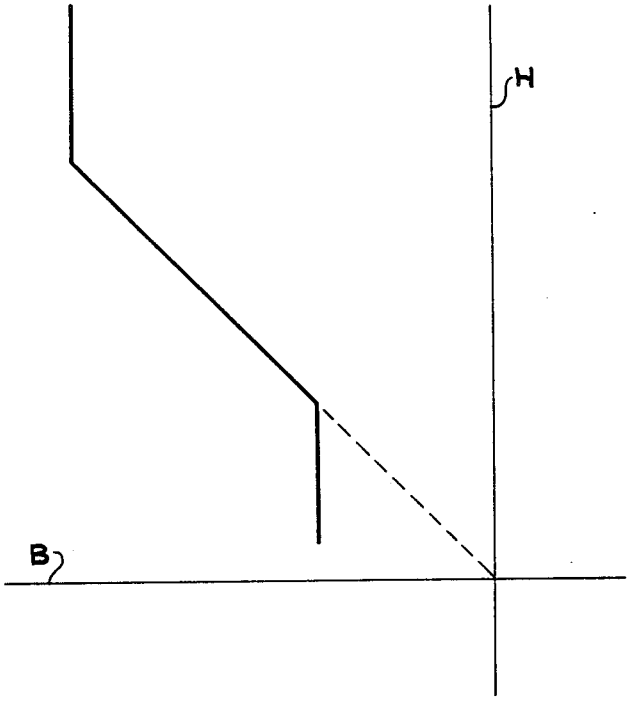
FIG. 4 is a graph schematically showing the displacement of the B-I curve from the conventional curve of FIG. 3 by use of the undulator of the invention.

The results of the practice of the invention in achieving this goal may be seen in comparing the curve of FIG. 3, representing an undulator built using only electromagnets with the curve shown in FIG. 4 representing results achieved using the undulator of the invention. It will be noted that the limiting field values in FIG. 4 have moved up along the straight line going through the origin.

Thus, the invention provides an improved undulator characterized by the achieveability of high field strength when still maintaining the adjustability of the magnetic field due to the use of a mixture of permanent magnets and electromagnets in the construction of the magnetic poles of the undulator to inhibit saturation of the electromagnets.

While a specific embodiment of the improved undulator of the invention has been illustrated and described, modifications and changes of the apparatus, parameters, materials, etc. will become apparent to those skilled in the art, and it is intended to cover in the appended claims all such modifications and changes which come within the scope of the invention.

What is claimed is:

1. In an undulator wherein a plurality of electromagnet poles are located along opposite sides of a particle beam axis normal to the beam axis with alternate north and south poles on each side of the beam to cause the beam to wiggle or undulate as it travels generally along said beam axis, the improvement which comprises reducing the saturation of said electromagnet poles by the use of permanent magnets spaced in between adjacent electromagnetic poles on each side of said axis of said particle beam in an orientation wherein the north and south poles of said permanent magnets are parallel to the particle beam axis and normal to the magnetic axes of said electromagnetic poles to reduce the saturation of said electromagnets to thereby permit the increasing of the field strength of the electromagnets beyond normal saturation levels.

2. The improved undulator of claim 4 wherein the north poles of said permanent magnets which are normal to said electromagnetic poles face toward the north electromagnetic poles and away from the south electromagnetic poles.

3. An improved undulator having a plurality of electromagnet poles located along opposite sides of a particle beam axis with alternate north and south poles on each side of the beam to cause the beam to wiggle or undulate as it travels generally along said beam axis, triangular shaped permanent magnets spaced in between adjacent electromagnetic poles on each side of said axis of said particle beam and having an enlarged portion adjacent the pole faces of said electromagnets and a magnetic orientation normal to the orientation of the magnetic axis of said electromagnet poles with the north pole of each of said permanent magnets facing toward said north electromagnet poles to reduce the saturation of said electromagnet poles to thereby permit the increasing of the field strength of the electromagnet poles beyond normal saturation levels.

4. In an undulator wherein a plurality of electromagnet poles are located along opposite sides of a particle beam axis normal to the beam axis with alternate north and south poles on each side of the beam to cause the beam to wiggle or undulate as it travels generally along said beam axis, the improvement which comprises reducing the saturation of said electromagnet poles by the use of permanent magnets placed in between adjacent electromagnetic poles on each side of said axis of said particle beam with an enlarged portion of said permanent magnets adjacent the faces of said electromagnet poles and wherein the north and south poles of said permanent magnets spaced between said electromagnet poles are oriented parallel to the particle beam axis and normal to the magnetic axes of said electromagnet poles to reduce the saturation of said electromagnets to thereby permit the increasing of the field strength of the electromagnets beyond normal saturation levels.

5. In an undulator wherein a plurality of electromagnet poles are located along opposite sides of a particle beam axis normal to the beam axis with alternate north and south poles on each side of the beam to cause the beam to wiggle or undulate as it travels generally along said beam axis, the improvement which comprises reducing the saturation of said electromagnet poles by the use of permanent magnets placed in between adjacent electromagnetic poles on each side of said axis of said particle beam wherein said permanent magnets are generally triangular in shape in the plane normal to the beam path with the broadest portion of the triagnular shape closest to said beam path and wherein the north and south poles of said permanent magnets spaced between said electromagnet poles are oriented parallel to the particle beam axis and normal to the magnetic axes of said electromagnet poles to reduce the saturation of said electromagnets to thereby permit the increasing of the field strength of the electromagnets beyond normal saturation levels.

6. The improved undulator of claim 5 wherein the north poles of said permanent magnets which are normal to said electromagnetic poles face toward the north electromagnetic poles and away from the south electromagnetic poles.

* * * * *